US008813535B2

(12) United States Patent
Kolb

(10) Patent No.: US 8,813,535 B2
(45) Date of Patent: Aug. 26, 2014

(54) STAMPING-BENDING METHOD

(75) Inventor: Rudi Kolb, Rieden am Forggensee (DE)

(73) Assignee: Unimet GmbH, Rieden am Forggensee (DE)

( * ) Notice: Subject to any disclaimer, the term of this patent is extended or adjusted under 35 U.S.C. 154(b) by 476 days.

(21) Appl. No.: 13/026,467

(22) Filed: Feb. 14, 2011

(65) Prior Publication Data

US 2011/0203344 A1 Aug. 25, 2011

(30) Foreign Application Priority Data

Feb. 25, 2010 (DE) ..... 10 2010 000 551

(51) Int. Cl.

| | |
|---|---|
| ***B21D 13/00*** | (2006.01) |
| ***B31D 3/00*** | (2006.01) |
| ***B21D 13/10*** | (2006.01) |
| ***B21D 33/00*** | (2006.01) |
| ***B21D 13/08*** | (2006.01) |

(52) U.S. Cl.

CPC ..... *B21D 33/00* (2013.01); *B31D 3/002* (2013.01); *B21D 13/10* (2013.01); *B21D 13/08* (2013.01)

USPC ..... 72/379.6

(58) Field of Classification Search

USPC ..... 72/187, 381, 384, 385, 379.6, 184, 380, 72/379.2

See application file for complete search history.

(56) References Cited

U.S. PATENT DOCUMENTS

| | | | | |
|---|---|---|---|---|
| 3,376,684 | A * | 4/1968 | Cole et al. | 72/379.6 |
| 6,354,368 | B1 * | 3/2002 | Nishishita et al. | 165/135 |
| 2006/0143919 | A1 * | 7/2006 | Bruck et al. | 72/385 |
| 2006/0168810 | A1 * | 8/2006 | Haesemann et al. | 29/890 |
| 2007/0029073 | A1 * | 2/2007 | Teshima et al. | 72/379.6 |
| 2009/0274431 | A1 * | 11/2009 | Krampotich et al. | 72/379.2 |

* cited by examiner

*Primary Examiner* — Teresa M Ekiert

(74) *Attorney, Agent, or Firm* — Notaro, Michalos & Zaccaria P.C.

(57) ABSTRACT

The instant invention relates to a multi-stage stamping-bending method for introducing a primary and at least one secondary structure into a band-shaped metal foil, wherein, after passing through the multi-stage stamping-bending method, the metal foil encompasses at least two 180° bends between primary and at least one secondary structure along the wave train of the primary structure within one wave of the primary structure, in the case of which the primary structure is introduced into the metal foil during a first bending method step so as not to be formed completely in all of its areas, in the case of which the primary structure is embodied completely in its remaining areas during a subsequent second bending method steps and in the case of which the at least one secondary structure is introduced into the metal foil in a completely formed manner during a subsequent third bending method step, wherein the metal band passes through the method steps back-to-back.

4 Claims, 2 Drawing Sheets

STAMPING-BENDING METHOD

Figure 1:
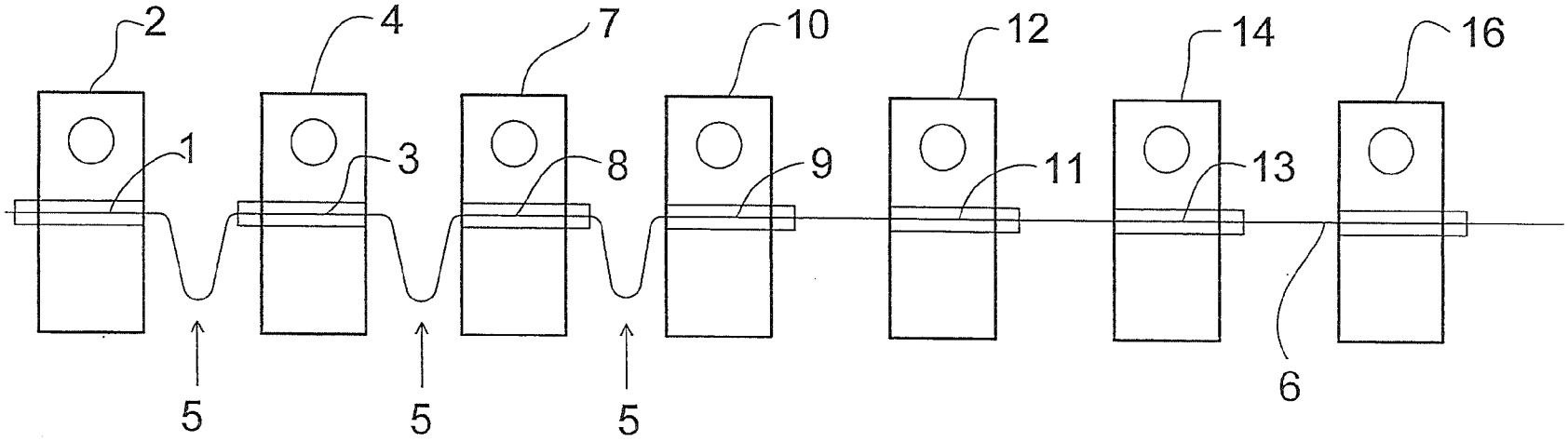

The instant invention relates to a multi-stage stamping-bending method for introducing a primary and at least one secondary structure into a very thin, band-shaped metal foil, wherein, after passing through the multi-stage stamping-bending method, the metal foil encompasses at least two 180° bends between primary and at least one secondary structure along the wave train of the primary structure within one wave of the primary structure.

Such complexly structured, very thin metal foils are used diversely, but in particular as catalyst carriers in the areas of exhaust gas treatment. In the case of catalysts, a particularly large surface is important, as is known. At the same time, the catalysts are to only offer a small flow resistance to the gas flow, are not to encompass a large dead weight due to the extremely rapid thermal heating to the operating temperature, which is required, and must thus be formed from a correspondingly thin material layer. Typical material thicknesses are less than 0.2 mm. It is difficult to process such thin metal foils, because deformations can easily cause damages to the material structure. To create a large surface, three-dimensional structures, typically primary and secondary structures, are introduced in the case of known metal foils. Primary structure thereby routinely refers to a spatial structure of the metal foil, which encompasses the largest wavelength along the longitudinal axis of the metal foil underneath the structures of the metal foil. Viewed along a longitudinal side of the completely structured metal foil, such waves can thereby be embodied in a more or less sinusoidal, rectangular, square, triangular manner or the like, wherein the average gradients of the rising or falling journals can differ from one another or can be similar. Round shapes are preferred in general, due to the better flow ratios and the simpler and more permanent coatability. According to the invention, the secondary structure or structures is/are understood to be such structures, which encompass a shorter wavelength than the primary structure, which are therefore introduced into the primary structure, which is formed first, so that one or a plurality of structural elements of the secondary structure fall into one or less structural elements of the primary structure, for example into a half wave. Typically, primary and secondary structure are only introduced into the metal foil after material had first been stamped out so as to provide for the deformation.

In response to the introduction of the structure by means of deformation, the metal material, typically stainless steel, is not to be crumpled, disruptions or ridges are not to appear, a strict dimensional accuracy is required, in particular with a gap width of below 0.1 mm. Finally, a production method must also operate at higher material feed rates, so as to provide for an economical production of the structured metal foil.

It is thus extremely difficult to form such highly-complex metal foils, in particular meshing gears are completely unsuitable for this purpose. The material characteristics and the desired complex structure of the finished product thus have a strong influence on the method steps. The use of composite tools, which are equipped with stamping and bending stations and in the case of which a device encompasses a plurality of processing stations, which operate successively and which are clocked, is known in the state of the art.

The instant invention thus faces the object of specifying a method, by means of which such thin metal foils, which are structured in a highly complex manner, can be produced.

This object is solved by means of a method, in the case of which the primary structure is introduced into the metal foil during a first bending method step so as not to be formed completely in all of its areas, in the case of which the primary structure is embodied completely in its remaining areas during a subsequent second bending method step and in the case of which the at least one secondary structure is introduced into the metal foil in a completely formed manner during a subsequent third bending method step, wherein the metal band passes through the method steps back-to-back. To her surprise, the applicant determined that the object, which she faces, can only be solved in that the primary structure is not already introduced completely into the metal band in the first operating step. The material characteristics allow for a dimensionally accurate further processing only when the primary structure is molded incompletely initially. Surprisingly, it is hereby most advantageous when the primary structure is already introduced in several areas in the finished size and when the remaining areas are brought to the finished size only in a second step. It was possible to introduce the required highly-complex structure in a dimensionally accurate manner only by means of the additional introduction of a further operating step. Surprisingly, it was not possible to initially bring all areas to an approximate finished size and to then bring all areas to the finished size. Surprisingly, one area or a plurality of areas of the primary structure had to instead be brought to the finished size and the remaining areas were brought to the finished size in a second step. Highly advantageously, this inventive process allows for the subsequent introduction of at least one secondary structure in the immediate finished size. It is also important that the arrangement of the method steps provides for a material reserve between method steps, so that the processing in the bending stations is not obstructed by tensile forces.

It is particularly advantageous when a stamping method step takes place prior to the bending method step. Through this it is possible to introduce guide holes as well as the required recesses for the later bends, so that this can take place in a tear and crease-free manner.

In an embodiment of the method according to the invention, provision is made for a further secondary structure to be introduced into the meal foil in a completely formed manner in a subsequent bending method step. Surprisingly, it is not necessary in response to the introduction of the secondary structure to bring partial areas of the secondary structure to the finished size initially and the remaining areas in a second step. Instead, the secondary structure can be introduced in its finished size immediately according to the invention with advantageous time and tool savings.

In the event that provision is made between the first four method steps for a metal band intermediate storage in each case, the material can be processed in a tension-free manner without tensile forces, which have a negative impact.

In the event that the at least one secondary structure is introduced horizontally beveled to the primary structure, in particular in the event that a second secondary structure is additionally introduced beveled to the first secondary structure, the required complex geometry of the finished metal band is made possible in a highly advantageous manner.

The invention will be defined below in more detail by means of the figures, which refer to a preferred exemplary embodiment. In detail FIG. 1 shows a schematic overview of the method steps, FIG. 2 shows a perspective section of the finished metal foil produced with the method and FIG. 3 shows a top view onto a part of the finished metal foil.

In a schematic drawing, FIG. 1 shows the individual operating steps of the claimed method. They preferably run within a progressive tool, which includes the individual tools in a common tool carrier. The tools operate in a clocked manner so as to be tuned to one another, so that a material band is conveyed gradually through the progressive tool. In the method according to the invention, a stamping band is processed, which has a width of between 100 mm and 150 mm and which encompasses a material thickness of 0.11 mm. In this example, it is a stainless steel stamped band.

The five-stage method herein starts with a stamping step 1 in a stamping station 2, followed by a first pre-bending step 3 of the primary structure in a first bending station 4. A material reserve 5, the length of which can be changed and which forms an intermediate material storage and which thus accommodates for the relative material shortening, which occurs in response to the bending, is located between both stations 2, 4. In the stamping step 1, guide holes are stamped into the stamping band 6, at which it is transported through the progressive tool. The material areas, which would cause problems in response to the subsequent deformations, are furthermore stamped out. In the first bending station 4, the primary structure is molded into the stamping band in the shape of a V, wherein a predetermined angular ratio and an accurately determined radius are already molded at the V-shaped tip. A finished wave crest section of the primary structure is thus formed, the dimensions of which are maintained in the further process. The angular ratio is particularly important, because it would otherwise not be possible to carry out the further process. A second bending station 7, in which the final bending 8 of the primary structure takes place, follows the first bending station 4. This final bending 8 transforms the currently molded V-shaped profile of the primary structure into a rectangular U-profile. The pre-bending step 3 and the final bending step 8 in each case lead to a shortening of the stamping band 6, so that provision is also made between the first and second bending station 4, 7 for a material reserve 5. A third and fourth bending step takes place after these first two bending steps 4, 7, wherein the third bending step 9 takes place in a third bending station 10. At that location, a secondary structure, namely here into the upper side of the primary structure, is molded into the primary structure, which had been created in the finished size until that point. The fourth bending step 11 in the fourth bending station 12 then molds a further secondary structure into the primary structure, namely into the side of the primary structure, which is located opposite to the first secondary structure. These two secondary structures are inclined relative to one another; they encompass in particular an angle of approximately 90° to one another. This structure can be found in FIG. 2. This molding process is followed by a separating station 14 with a separating step 13, followed by a packaging station 16 of the completely structured metal foil.

Figure 2:
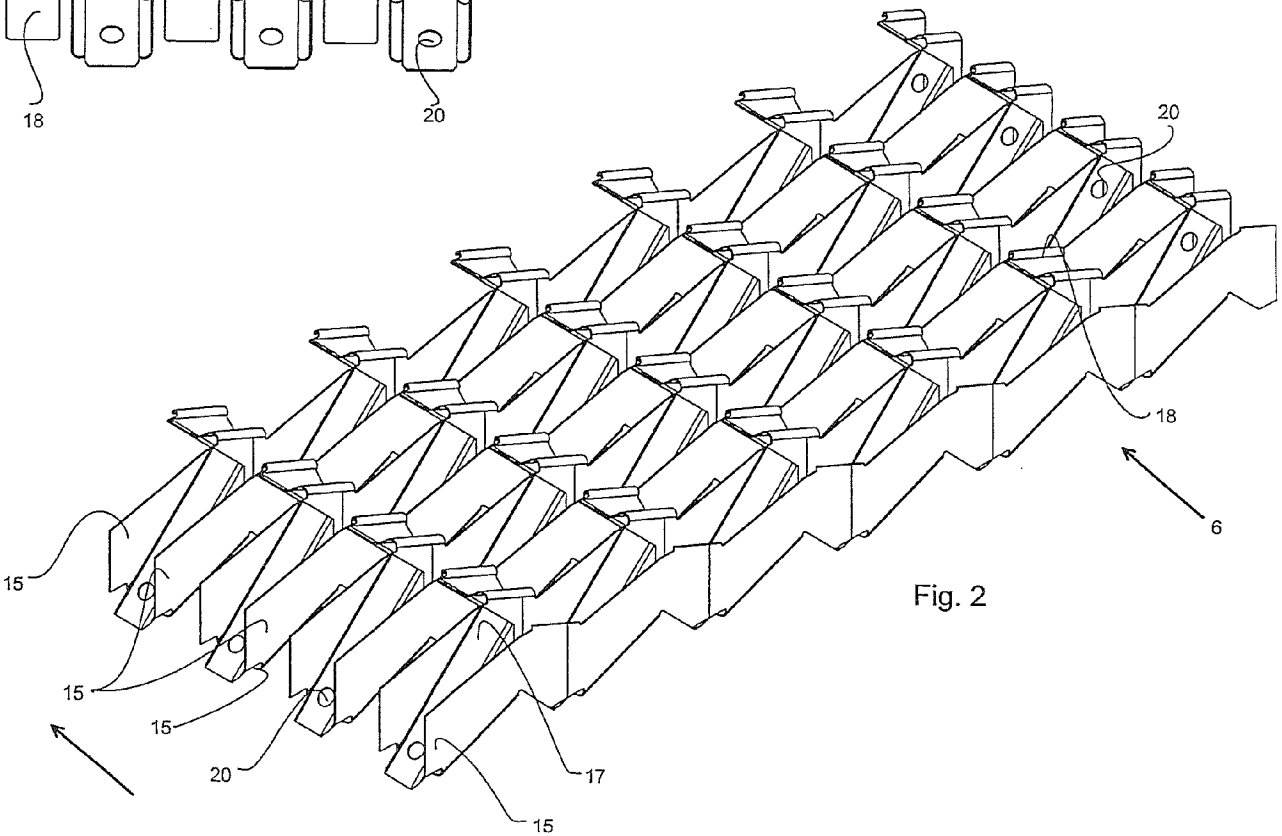
Figure 3:
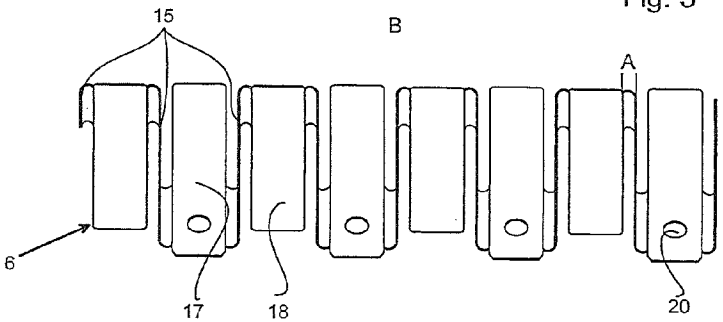

The complex structure of the metal foil, which is created according to the invention, can be seen well in FIG. 2. It shows a perspective top view onto a wave train of primary and secondary structure, which extends along the arrow. The arrow simultaneously represents the production direction of the stamping band 6. The primary structure 15 is formed by means of rectangular, u-shaped waves, which were initially introduced into the stamping band in two steps as described. The stamping holes 20, which were introduced during the first method step for conveying the stamping band 6 through the progressive tool, can also be identified. The first secondary structure 17 was introduced in that the wave crest of the primary structure was indented from the top such that the stamping band material was bent over twice by 180° and was additionally inclined to the primary structure within one wave of the primary structure 15. The second secondary structure 18 is embodied so as to be inclined to the first primary structure 17 and also so as to be inclined to the primary structure 15.

FIG. 3 shows a top view onto a section of a completed stamping band 6, which was produced by means of the described method. The primary structure 15 consists of rectangular, u-shaped waves. A first and a second secondary structure 17, 18 are molded in a wave train of the primary structure, wherein a secondary structure is molded in a wave crest or wave a wave trough, respectively. The two secondary structures 17, 18 are arranged to one another approximately at an angle of 90°, run inclined to the primary structure 15 and encompass strictly parallel walls to the walls of the primary structure 15. The distance A of the walls to one another is 0.9 mm, a wave train B of the primary structure extends across 11 mm, a secondary structure extends across 3.6 mm.

Highly advantageously, the method according to the invention opens up the possibility of efficiently producing complexly shaped, very thin metal bands. The material characteristics can be overcome and more planar walls can be created only in that a primary structure is not immediately molded in the finished size, but in that a part of the primary structure is instead brought to the finished size and another part is not initially, with this part then also being brought to the finished size in a second deformation step. This is necessary, because a lateral guiding of the tools is not possible in response to the introduction of the secondary structure due to the narrowness of the gap width.

LIST OF REFERENCE NUMERALS

1 stamping step
2 stamping station
3 pre-bending step
4 first bending station
5 material reserve
6 stamping band
7 second bending station
8 final bending
9 third bending step
10 third bending station
11 fourth bending step
12 fourth bending station
13 separating step
14 separating station
15 primary structure
16 packaging station
17 first secondary structure
18 second secondary structure
19
20 stamping holes

The invention claimed is:

1. A method for producing a band-shaped metal foil using a progressive tool carrier with individual tools being mounted in a common tool carrier, said metal foil being of a thickness less than 0.2 mm, and said metal foil having a primary structure comprising U-shaped waves and at least one secondary structure, the method comprising the following steps:

stamping the metal foil;

bending the metal foil to form the primary structure in the metal foil and wherein a part of the primary structure is formed in its final dimension;

bending the metal foil to completely form the primary structure;

bending the metal foil at least twice by 180 degrees to form a first secondary structure in its final dimensions and said first secondary structure having a shorter wavelength than the primary structure;

bending the metal foil to form a second secondary structure in its final dimensions and said second secondary structure having a shorter wavelength than the primary structure; and whereby the first and second secondary structures are molded into the primary structure during the bending steps.

2. A method for producing a band-shaped metal foil as recited in claim 1, wherein each bending step occurs at a bending station and material reserve is provided between each bending station.

3. A method for producing a band-shaped metal foil as recited in claim 1, wherein the second secondary structure is horizontally beveled.

4. A method for producing a band-shaped metal foil as recited in claim 1, wherein the primary structure is molded in the shape of a V having a tip and a predetermined angular ratio, and an accurately determined radius at the V-shaped tip, and wherein a final bending step transforms the V-shaped profile of the primary structure into a rectangular u-profile.

* * * * *